US006451082B1

(12) United States Patent
Ozaki et al.

(10) Patent No.: US 6,451,082 B1
(45) Date of Patent: Sep. 17, 2002

(54) IRON-BASED POWDER MIXTURE FOR POWDER METALLURGY, PROCESS FOR PRODUCING THE SAME, AND METHOD OF FORMING A MOLDING FROM THE SAME

(75) Inventors: Yukiko Ozaki; Satoshi Uenosono, both of Chiba; Kuniaki Ogura, Chiyoda-ku, all of (JP)

(73) Assignee: Kawasaki Steel Corporation, Kobe (JP)

( * ) Notice: Subject to any disclaimer, the term of this patent is extended or adjusted under 35 U.S.C. 154(b) by 26 days.

(21) Appl. No.: 09/749,576

(22) Filed: Dec. 28, 2000

(30) Foreign Application Priority Data

Jan. 7, 2000 (JP) ..... 2000-001180
Sep. 7, 2000 (JP) ..... 2000-270872

(51) Int. Cl.[7] ..... B22F 1/02
(52) U.S. Cl. ..... 75/252; 419/64; 419/65; 419/66
(58) Field of Search ..... 75/252; 419/64, 419/65, 66

(56) References Cited

U.S. PATENT DOCUMENTS

| | | | | |
|---|---|---|---|---|
| 4,043,846 A | * | 8/1977 | Amemiya et al. | 148/105 |
| 4,437,882 A | * | 3/1984 | Umemura et al. | |
| 5,256,185 A | | 10/1993 | Semel et al. | |
| 5,368,630 A | | 11/1994 | Luk | |
| 5,800,636 A | * | 9/1998 | Tsukada et al. | 148/306 |
| 5,989,304 A | * | 11/1999 | Ozaki et al. | 75/252 |
| 6,235,076 B1 | * | 5/2001 | Ozaki et al. | 75/252 |

FOREIGN PATENT DOCUMENTS

| | | |
|---|---|---|
| JP | 56-136901 | 10/1981 |
| JP | 58-28321 | 2/1983 |
| JP | 59-023801 | 2/1984 |
| JP | 2-47201 | 2/1990 |
| JP | 2-57602 | 2/1990 |
| JP | 2-156002 | 6/1990 |
| JP | 3-162502 | 7/1991 |
| JP | 7-103404 | 4/1995 |
| JP | 8-259847 A | 10/1996 |
| JP | 9-104901 | 4/1997 |
| JP | 1-165701 | 6/1998 |
| JP | 10-317001 | 12/1998 |

OTHER PUBLICATIONS

Uenosono, Ozaki and Ogura, "Powder and Powder Metallurgy," 1998, vol. 45, p. 849.

* cited by examiner

*Primary Examiner*—Ngoclan Mai
(74) *Attorney, Agent, or Firm*—Oliff & Berridge, PLC

(57) ABSTRACT

An iron-based powder composition is provided that is greatly flowable and compactible and less dependent on temperature with respect to flowability and compactibility at room temperature or during warming. The iron-based powder composition includes an iron-based powder, a lubricant melted and fixed to the iron-based powder, an alloying powder bonded to the iron-based powder with the aid of the lubricant, and a free lubricant. One or more constituent members are coated with an organosiloxane layer in a coating ratio of greater than about 80%. The organosiloxane has phenyl groups as a functional group. The lubricant melted and fixed to the iron-based powder is a composite melt composed of a calcium soap and a lithium soap, or a composite melt composed of a calcium soap and an amide lubricant. The free lubricant is a mixed powder composed of an amide lubricant and a methyl polymethacrylate powder, or a lithium soap powder. A process for producing the iron-based powder composition is also provided.

17 Claims, 1 Drawing Sheet

IRON-BASED POWDER MIXTURE FOR POWDER METALLURGY, PROCESS FOR PRODUCING THE SAME, AND METHOD OF FORMING A MOLDING FROM THE SAME

BACKGROUND OF THE INVENTION

1. Field of Invention

This invention is directed to iron-based powder compositions for use in powder metallurgy.

2. Description of Related Art

In general, an iron-based powder composition for powder metallurgy is produced by mixing an iron powder with an alloying powder such as copper powder, graphite powder or iron phosphide powder, and where needed, with a cutting improver powder, and a lubricant such as zinc stearate, aluminum stearate or lead stearate. Such a lubricant has heretofore been chosen by taking into account miscibility with metallic powder and freedom from elimination during sintering.

Recently, a growing demand has been made for the development of sintered materials with great strength. To cope with this trend, warm molding techniques have been proposed, which can form a molding having high density and great strength by molding a metallic powder with heating, as disclosed in Japanese Unexamined Patent Application Publication No. 2-156002 and Japanese Examined Patent Application Publication No. 7-103404 and U.S. Pat. Nos. 5,256,185 and 5,368,630. With regard to lubricants to be used in these molding techniques, importance is further placed on lubricity during heating in addition to the requirements of miscibility with metallic powder and freedom from elimination during sintering.

Namely, when being partly or wholly dissolved during warm molding, a lubricant needs to be uniformly dispersed in between the particles of a metallic powder. This brings about reduced friction resistance between the metallic particles and between the resultant compact and the corresponding die, consequently leading to improved compactibility.

However, the above-mentioned metallic powder composition has a first drawback that it causes undesirable segregation in its starting mixture containing an alloying powder and the like, and a second drawback that it suffers poor flowability during warming.

To alleviate the first drawback, i.e., to prevent the metallic powder composition from being segregated, a technique is known which employs a binding agent, as disclosed in Japanese Unexamined Patent Application Publication Nos. 56-136901 and 58-28321. However, when the binder is added in large amounts in preventing the metallic powder composition sufficiently from segregation, another problem arises that the powder composition becomes less flowable.

The present inventors have previously proposed to use as a binder a metallic soap or a composite melt composed of wax and oil, as disclosed in Japanese Unexamined Patent Application Publication Nos. 1-165701 and 2-47201. These techniques are capable of reducing segregation and dusting in a metallic powder composition to a markedly great extent, thus imparting improved flowability to the powder composition. But, the techniques are considered unsatisfactory in that the flowability of the powder composition becomes worse with time due to the means provided above for preventing the problem of segregation.

For that reason, the present inventors have further proposed that a high-melting composite melt composed of an oil and a metallic soap be used as a binding agent, as disclosed in Japanese Unexamined Patent Application Publication No. 2-57602. This technique has the advantage that such a composite melt does not vary significantly flowability with time, allowing the stock powder composition to be less susceptible to flowability variation even after a lapse of time. In such an instance, however, there is posed another problem that the powder composition becomes varied with respect to apparent density because an iron-based powder is mixed with a saturated fatty acid that has a high melting point and is solid at room temperature and with a metallic soap.

In an effort to solve this problem, the present inventors have proposed a technique in which an iron-based powder is coated on its surface with a fatty acid, followed by bonding additives to the coated surface of that powder with the aid of a composite melt composed of a fatty acid and a metallic soap, and by successive application of a metallic soap to the coated bonded surface of the iron-based powder. This technique is described in Japanese Unexamined Patent Application Publication No. 3-162502.

Segregation, dusting and other problems have been appreciably alleviated by virtue of the techniques disclosed in Japanese Unexamined Patent Application Publication Nos. 2-57602 and 3-162502, both of which are described above. However, these techniques provide no satisfactory solution to flowability. This is particularly true of flowability during heating in so-called warm compaction in which a powder composition after being heated up to about 150° C. is filled in a die heated at a similar temperature and then is compacted.

Also, in the techniques of Japanese Unexamined Patent Application Publication No. 2-156002, Japanese Examined Patent Application Publication No. 7-103404 and U.S. Pat. Nos. 5,256,185 and 5,368,630 which, as cited above, are designed to improve compactibility in warm compaction, a metallic powder composition suffers from poor flowability during warming because a low-melting lubricant component forms wet crosslinking in between the metallic particles. Insufficient flowability makes compacting less productive, and moreover, causes irregular density in the compacts, which in some cases gives a sintered product having varied properties.

With regard to insufficient flowability of a metallic powder composition during warming that is described above as the second drawback, the present inventors have proposed processes for producing an iron-based powder composition, which are disclosed in Japanese Unexamined Patent Application Publications Nos. 9-104901 and 10-3 17001. Each such process permits an alloying powder to be free of segregation during warming and also permits a metallic powder composition to be more highly flowable during warming.

In the above processes, the alloying powder can be prevented from being segregated during warming, and the metallic powder composition can be improved in respect of flowability during warming, which effects are attained by the steps of coating at least one of an iron-based powder and an alloying powder with a surface-treating agent; mixing the iron-based powder and alloying powder with lubricants such as a fatty acid, a fatty acid amide and a metallic soap; after mixing, heating the resultant mixture at a temperature higher than the melting point of at least one of the lubricants, thereby melting at least one lubricant; cooling the mixture with stirring, thereby bonding an alloying powder to the surface of the iron-based powder; and, after further cooling, incorporating the cooled mixture with lubricants such as a fatty acid, a fatty acid amide and a metallic soap.

According to the techniques of Japanese Unexamined Patent Application Publication Nos. 9-104901 and 10-317001 both cited above, the flowability of the iron-based powder mixture in warm compaction is remarkably improved. From studies made by the present inventors, it has been presumed that such a desirable effect could be obtained by coating the surfaces of an iron-based powder and an alloying powder with a surface-treating agent composed of an organic component, thus decreasing the potential difference between the associated lubricants of low electric conductivity and the surface of the iron-based powder or alloying powder of high electric conductivity. This reduces the possibility of the iron-based powder or alloying powder sticking to the lubricants by contact electrification and enhances the possibility of the iron-based powder and alloying powder becoming wettable with the molten lubricants in a warm region. Unfavorably, however, such an iron-based powder composition is less flowable at relatively high temperatures. To ensure high flowability during warm compaction, the temperatures of the iron-based powder and the corresponding die should be strictly controlled. According to studies made by the present inventors, the insufficient flowability at relatively high temperatures mentioned above presumably results from too low a coating ratio of a surface-treating agent applied to the surfaces of an iron-based powder and an alloying powder. When being not coated with the surface-treating agent, the iron-based powder and alloying powder are less wettable with lubricants used. Immediately after the temperature rises above the melting point of one of the lubricants, the molten lubricant having stayed between the iron-based particles and the alloying particles forms wet crosslinking so that the powder composition becomes agglomerated and hence less flowable at relatively high temperatures.

SUMMARY OF THE INVENTION

In order to solve the foregoing problems of the conventional art, therefore, one object of this invention is to provide an iron-based powder mixture for use in powder metallurgy, which is superior in flowability and compressibility at from room temperature to a region of high warming temperatures, and is less dependent on temperature in respect of flowability and apparent density, as well as green density of constituent powders.

This invention also provides a process for producing such an iron-based powder composition.

Another object of this invention is to provide a method of forming an iron-based powder compact, which is capable of forming such an iron-based powder composition into a high-density iron-based powder compact.

The present inventors have conducted intensive research on factors that dominate the flowability properties of iron-based powder compositions, thus finding a that the flowability is largely influenced by the surface states of an iron-based powder and/or an alloying powder, particularly by the substances of layers formed on the powder surfaces and by the coating ratios of the layer. From continued research on the chemical structures of layers formed to coat the constituent powders, the present inventors have found that when being coated in a coating ratio of not smaller than about 80% with an organosiloxane layer, the powders become greatly wettable with a molten lubricant and hence give an iron-based powder composition with flowability improved at a markedly high level.

Furthermore, the present inventors have found that the temperature dependence of flowability in an iron-based powder composition is largely variable with the amounts of water which get absorbed on the surfaces of the constituent powders and vary with temperature increases.

It has also been found that the amounts of water eliminated with temperature increases and absorbed on the powder surfaces can be made less variable when the powder surfaces are coated with an organosiloxane layer in a coating ratio of greater than about 80%, such that the quantities of water molecules to be adsorbed to the powder surfaces at around room temperature are so controlled as to be constant. Still another finding is that when an organosiloxane layer is formed on the powder surfaces, the powders become highly wettable with lubricants, the iron-based particles become easily slidable at low temperatures (at around room temperature) so that they are speedily rearranged to improve compression density at low temperatures and to reduce temperature dependence during compacting.

This invention has been made with further consideration given to the above findings.

More specifically, according to a first aspect of this invention, there is provided an iron-based powder composition for use in powder metallurgy comprising an iron-based powder, a lubricant melted and fixed to the iron-based powder, an alloying powder bonded to the iron-based powder with the aid of the lubricant, and a free lubricant powder. At least one member selected from the group consisting of the iron-based powder, lubricant, alloying powder and free lubricant powder is coated on the surface thereof with an organosiloxane in a coating ratio of greater than about 80%.

Preferably, the organosiloxane has phenyl groups as a functional group. The lubricant is one member selected from the group consisting of a composite melt composed of a calcium soap and a lithium soap, and a composite melt composed of a calcium soap and an amide lubricant. The free lubricant powder is one member selected from the group consisting of a mixed powder composed of an amid lubricant and a methyl polymethacrylate powder, and a lithium soap powder.

Also, the amide lubricant is preferably represented by the following formula:

$$C_zH_{2z-1}CONH(CH_2)_2NH(CO(CH_2)_8CONH(CH_2)_2NH)_x COC_yH_{2y+1} \quad (1)$$

where the subscript x denotes an integer of from 1 to 5, the subscript y denotes an integer of 17 or 18, and the subscript z denotes an integer of 17 or 18.

Also, the methyl polymethacrylate powder is preferably an agglomerate in which spherical particles are preferably with an average diameter in the range of from about 0.03 to about 5 $\mu$m. The average diameter of the agglomerate is preferably in the range of from about 5 to about 50 $\mu$m.

The free lubricant powder is present preferably in the range of from about 25 to about 80% by mass relative to the total amount of the lubricants.

According to a second aspect of this invention, there is provided a process for producing an iron-based powder composition for use in powder metallurgy comprising: coating at least one of an iron-based powder and an alloying powder with an organoalkoxysilane that has been mixed in advance with water; primarily mixing the iron-based powder and the alloying powder by the addition of one or more lubricants; heating the primary mixture with stirring at a temperature higher than the melting point of at least one of the lubricants, thereby melting at least one lubricant; cooling the mixture, wherein at least one lubricant has been melted, with stirring, thereby bonding the alloying powder to the iron-based powder with the aid of at least one lubricant, which has been melted and fixed to the surface of the iron-based powder; and subsequently performing secondary mixing by the addition of one or more lubricants.

In the second aspect, preferably when two or more lubricants are used in the primary mixing, the lubricants have respective different melting points. Also, one or more lubricants used in the primary mixing is preferably selected from a mixture composed of a calcium soap and a lithium soap, and a mixture composed of a calcium soap and an amide lubricant, whereas one or more lubricants used in the secondary mixing are selected from a mixed powder composed of an amide lubricant and a methyl polymethacrylate powder, and a lithium soap powder.

In the second aspect, preferably the amide lubricant is represented by the following formula:

$$C_zH_{2z+1}CONH(CH_2)_2NH(CO(CH_2)_8CONH(CH_2)_2NH)_x COC_yH_{2y+1} \quad (1)$$

where the subscript x denotes an integer of from 1 to 5, the subscript y denotes an integer of 17 or 18, and the subscript z denotes an integer of 17 or 18. Also, the methyl polymethacrylate powder is preferably an agglomerate in which spherical particles have been agglomerated preferably with an average diameter in the range of from about 0.03 to about 5 $\mu$m. The average diameter of the agglomerate is preferably in the range of from about 5 to about 50 $\mu$m.

In the second aspect, preferably the amounts of one or more lubricants used in the secondary mixing are preferably in the range of from about 25 to about 80% by mass relative to the total amount of the lubricants used in the primary and secondary mixing.

In the second aspect, preferably the lowest-melting lubricant of the one or more lubricants used in the primary mixing has a lower melting point than the lowest- melting lubricants of the one or more lubricants used in the secondary mixing, and the heating temperature during the primary mixing is set to be between the melting points of the two lowest-melting lubricants.

According to a third aspect of the invention, there is provided a process for producing an iron-based powder composition for use in powder metallurgy comprising: primarily mixing an iron-based powder and an alloying powder by the addition of one or more lubricants; heating the primary mixture with stirring at a temperature higher than the melting point of at least one of the lubricants, thereby melting the one lubricant; cooling the mixture, wherein at least one lubricant has been melted, with stirring, mixing an organoalkoxysilane that has been mixed in advance with water, in the course of cooling and in a temperature region of from about 100 to about 140° C., and bonding the alloying powder to the iron-based powder by the use of the at least one lubricant, which has been melted and fixed to the surface of the iron-based powder; and subsequently performing secondary mixing by the addition of one or more lubricants.

In the third aspect, preferably when two or more lubricants are used in the primary mixing, the lubricants have respective different melting points. Also, preferably one or more lubricants used in the primary mixing are selected from a mixture composed of a calcium soap and a lithium soap, and a mixture composed of a calcium soap and an amide lubricant, whereas one or more lubricants used in the secondary mixing are selected from a mixed powder composed of an amide lubricant and a methyl polymethacrylate powder, and a lithium soap powder.

In the third aspect, preferably the amide lubricant is represented by the following formula:

$$C_zH_{2z+1}CONH(CH_2)_2NH(CO(CH_2)_8CONH(CH_2)_2NH)_x COC_yH_{2y+1} \quad (1)$$

where the subscript x denotes an integer of from 1 to 5, the subscript y denotes an integer of 17 or 18, and the subscript z denotes an integer of 17 or 18. Preferably, the methyl polymethacrylate powder is an agglomerate in which spherical particles have been agglomerated preferably with an average diameter in the range of from about 0.03 to about 5 $\mu$m. The average diameter of the agglomerate is preferably in the range of from about 5 to about 50 $\mu$m.

In the third aspect, preferably the amounts of one or more lubricants used in the secondary mixing are in the range of from about 25 to about 80% by mass relative to the total amount of the lubricants used in the primary and secondary mixing. Also, preferably the lowest-melting lubricant of one or more lubricants used in the primary mixing has a lower melting point than the lowest-melting lubricants of one or more lubricants used in the secondary mixing, and the heating temperature during the primary mixing is set to be between the melting points of the two lowest-melting lubricants.

According to a fourth aspect of the invention, there is provided a method of forming an iron-based powder composition into a high-density, iron-based powder compact comprising compacting an iron-based powder composition according to the first aspect at a temperature within the range of higher than the lowest melting point of, but lower than the highest melting point of, lubricants contained in the iron-based powder mixture.

DESCRIPTION OF THE PREFERRED EMBODIMENTS

Figure 1A:
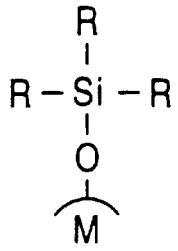
FIGS. 1A–1C show monomolecular films.

The invention will now be described in detail.

In a first aspect of this invention, an iron-based powder composition for use in powder metallurgy is composed of an iron-based powder, a lubricant melted and fixed to the iron-based powder, an alloying powder bonded to the iron-based powder with the aid of the lubricant, and a free lubricant powder. At least one member selected from the group consisting of the iron-based powder, lubricant, alloying powder and free lubricant powder is coated on the surface thereof with an organosiloxane in a coating ratio of greater than about 80%. This iron-based powder composition has superior flowability and compactibility.

The iron-based powder suited for the first aspect is chosen from pure iron powders, such as atomized iron powder and reduced iron powder, partly diffused alloyed steel powder, completely alloyed steel powder, and mixtures thereof. The partly diffused alloyed steel powder is preferably a steel powder that is derived by partially alloying one or more elements selected from among Cu, Ni and Mo. The completely alloyed steel powder is preferably an alloyed steel powder that is composed of one or more elements selected from among Mn, Cu, Ni, Cr, Mo, V, Co and W.

The alloying powder according to this invention contains at least graphite powder, and when desired, copper powder and cuprous oxide powder, contributing to increased strength of the finished sintered product.

Alloying powders other than graphite powder, copper powder and cuprous oxide powder that can be used include, for example, MnS powder, Mo powder, Ni powder, B powder, BN powder and boric acid powder. These powders may be used in combination.

The content of the alloying powder in the iron-based powder composition is set preferably within the range of from about 0.05 to about 10% by mass based on the total amount of the iron-based powder and alloying powder. The reason for selecting this content is that a sintered product can be obtained with great strength when graphite powder; a metallic powder, such as Cu, Mo and Ni; or an alloying powder, such as B powder, is used in a content of about 0.05% by mass or above. Conversely, alloying powder contents of larger than about 10% by mass make the finished sintered product dimensionally inaccurate. The content of graphite powder is more preferably in the range of from about 0.05 to about 1% by mass.

In the iron-based powder composition according to the first aspect, one or more members of an iron-based powder, a lubricant melted and fixed thereto, and an alloying powder are coated with an organosiloxane layer.

The term "organosiloxane layer" used herein means a layer in which organic groups R are bonded, through siloxane bonds (—SiO—), to metal atoms M on the surfaces of the iron-based powder and/or the alloying powder, and oxygen atoms O are attached to the metal atoms M. In this invention, phenyl groups are preferred for the organic groups R. Phenyl groups have the advantage that they permit the organic groups to be bulky, thus imparting improved lubricity to the resultant layer.

Figure 1B:
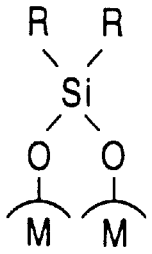
Figure 1C:
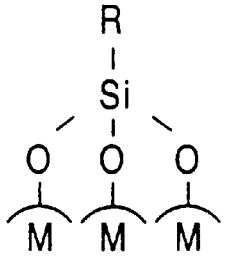
Figure 2A:
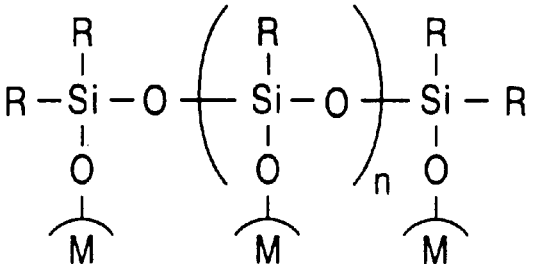
FIGS. 2A–2C show polymeric films.
Figure 2B:
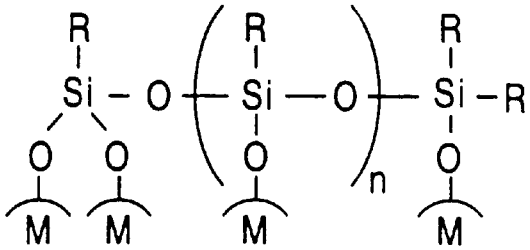
Figure 2C:
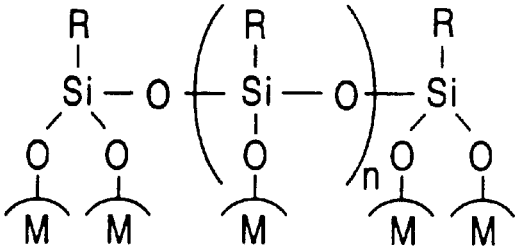
Figure 3:
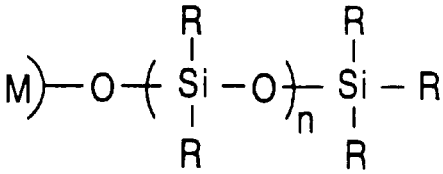
FIG. 3 shows a high-molecular film.

The organosiloxane layer has various chemical structures illustrated in the drawings, which layer can be formed by a condensation reaction of an organoalkoxysilane ($R_{4-m}Si(OR^1)_m$), an organochlorosilane ($R_{4-m}SiCl_m$), or an acyloxysilane ($R_{4-m}Si(OCOR^1)_m$) among organosilanes (where the substituent R denotes an organic group, the substituent R' denotes an alkyl group, and the subscript m denotes an integer of 1 to 3) with a hydroxyl group —OH, which is generated upon action of moisture to the terminal of an oxide film on the surface of the iron-based powder. The letter M in FIGS. 1A–3 denotes atoms other than the oxygen atoms on the surfaces of the iron-based powder and/or the alloying powder. FIGS. 1A–1C represent monomolecular layers, FIGS. 2A–2C represent polymeric layers, and FIG. 3 represents a high molecular layer. Included in the high molecular layer are those structured to have branched polysiloxanes $(R_2SiO)_n$ (where the subscript n denotes an integer).

The organosiloxane layer coated on the powder surfaces provides water molecule-adsorbing sites at the oxygen atoms O contained in the siloxane bonds (—SiO—), and one oxygen atom adsorbs one water molecule. Thus, where the powder surfaces are coated with the organosiloxane layer, the quantities of water molecules to be adsorbed on the powder surfaces can be controlled.

When no organosiloxane layer is coated on the powder surfaces, water molecules are adsorbed to the metal atoms on the iron-based powder and/or in the atoms on the alloying powder. In this case, water molecules sometimes infiltrate into the powders in depth, though depending on the moisture content in the air. Almost all of the water molecules thus adsorbed are eliminated from the powder surfaces as the temperature is raised. In the case of freedom from the organosiloxane layer on the powder surfaces, the iron-based powder composition causes a sharp decline in flowability and hence invites a large dependence of flowability on temperature.

In the meanwhile, where the powder surfaces are coated with the organosiloxane layer, water molecules to be adsorbed are restricted by the adsorption sites mentioned above so that the quantities of water molecules having been adsorbed are made smaller than in the case where a layer coating is omitted. This indicates that the iron-based powder composition coated on the surface with the organosiloxane film is slightly poor in flowability at room temperature as compared with a similar powder composition that is not so coated. However, because coating of the powder surfaces with the organosiloxane layer reduces the adsorbed water molecules tending to be eliminated with a temperature increase, the iron-based powder composition does not vary in flowability, even if only slightly variable, when the temperature changes.

The iron-based powder and the alloying powder that are coated with the organosiloxane layer are well wettable with a lubricant that has been melted on the powders. Hence, when being used with heating, the iron-based powder composition promptly wets with a lubricant that has been melted on the surfaces of the iron-based mixed particles. This renders the iron-based powder composition highly compactibility. Moreover, due to coating of the organosiloxane layer, the molten lubricant spreads uniformly between the particles of the iron-based powder composition and stays at particular positions without forming wet crosslinking between the particles. The fluidity of the iron-based powder composition is thus maintained up to higher temperatures.

The amounts of water absorbed on the powder surfaces can be controlled by the coating ratio of an organosiloxane (namely the amount of a starting silane to be added), the kind (such as of polarity or bulkiness) of organic groups contained in the organosiloxane, or the polymerization degree of a polymeric layer when used. To reduce the number of water molecule-adsorbing sites, thereby decreasing the amount of water to be adsorbed and making flowability less dependent on temperature, the organosiloxane layer should be coated in a coating ratio of about 80% or above on the powder surfaces. If this ratio is less than about 80%, a lubricant when being used in a molten state fails to spread uniformly between the particles of an iron-based powder composition and hence stays locally at certain particular positions so that it gets wet- crosslinked and agglomerated. This causes reduced flowability in the iron-based powder composition, which eventually imposes a restriction on the highest temperature in an acceptable region of working temperatures.

To coat the organosiloxane layer in a sufficient coating ratio, it is desired that an organoalkoxysilane after being incorporated with water should be mixed with at least an iron-based powder and/or an alloying powder, followed by heating of the mixture, as described below.

Generally, when a layer is applied to an inorganic material by the use of an oranoalkoxysilane as a starting substance, such compound converts into a silanol upon reaction with ambient water, which silanol undergoes subsequent condensation together with the hydroxyl groups existing on the surface of the inorganic material so that an organosiloxane layer is formed on the latter material. For this reason, the reaction system does not necessarily require water addition.

However, an iron-based powder for use as a stock powder in the production of an iron-based powder composition is stored in a low-humidity atmosphere so as to prevent rusting, and the powder composition is produced also in an atmosphere controlled at a low level of humidity. In this production, there is no source for water supply. If an organoalkoxysilane is simply mixed as such with the stock powder, the compound is liable to become only adsorbed on the surface of the stock powder in many instances and is less likely to react and convert to a silanol as mentioned above. In addition, in an iron-based powder, or an alloying powder that is treated in a non-oxidative atmosphere, the number of hydroxyl groups present on the powder surface is extremely small so that an organosiloxane layer cannot be adequately formed, which is obtained by mixing an organoalkoxysilane with the iron-based powder or the alloying powder and then by chemically bonding the compound to the powder surface.

In order to produce an iron-based powder composition, therefore, an organoalkoxysilane should preferably be mixed in advance with an amount of water required for an organosiloxane layer to be formed.

Alternatively, water may be added to an iron-based powder and/or an alloying powder, followed by addition of an organoalkoxysilane to the powders. As another alternative, an iron-based powder and/or an alloying powder may be mixed with an organoalkoxysilane, followed by addition of water to the whole mixture. However, in the case of separate use of water as in these alternative ways, the iron-based powder and/or the alloying powder wet-crosslink partly in between their respective particles and become segregated because water is high in surface tension. These powders thus fail to be sufficiently mixed with an organoalkoxysilane to be individually added so that the silanol conversion reaction of such a compound cannot readily initiate and proceed, which reaction should occur on the powder surfaces after the compound is added. Also, the iron-based powder often causes rusting. To overcome these problems, an organoalkoxysilane that has been mixed in advance with water should preferably be mixed with an iron-based powder and/or an alloying powder, followed by heating of the mixture.

A monomolecular layer or a polymeric layer other than a high-molecular layer is preferred as the organosiloxane layer.

As starting materials for the organosiloxane layer, organochlorosilane and organoacylosilane may be considered in addition to the organoalkoxysilane mentioned above. But the former compounds are less desired because they generate an acid upon condensation with an iron-based powder and hence rust the same.

As described above, the iron-based powder mixture can be advantageously made less temperature-dependent with respect to its flowability by coating at least one member of an iron-based powder, an alloying powder and a lubricant with an organosiloxane layer in a coating ratio of greater than about 80%.

In the second place, the lubricant for use in the first aspect of this invention will be described below.

The content of the lubricant to be used in the iron-based powder composition is preferably in the range of from about 0.01 to about 2.0 parts by weight based on 100 parts by weight of the iron-based powder and alloying powder in total. Contents of less than about 0.01 part by weight result in reduced fluidity and hence reduced compactibility. Contents of more than about 2.0 parts by weight cause reduced compression density and reduced strength of the resultant compressed product. The upper limit may be set more preferably at about 1.0 part by weight.

The operation of the lubricant according to this invention will now be described. Firstly, the lubricant acts as a binder for fixing the alloying powder to the iron-based powder. This is effective in preventing the alloying powder from being segregated and dusted. Secondly, the lubricant accelerates rearrangement and plastic deformation of the powders during pressure molding of the iron-based powder composition. This effectively leads to improved compression density and also to lessened ejecting force in ejecting the compact from a die after completion of the compaction.

To attain these effects, the iron-based powder composition should preferably be produced by mixing an iron-based powder with an alloying powder and one or more lubricants, heating the resultant mixture with stirring at a temperature of higher than the melting point of at least one lubricant when two or more lubricants are used in admixture, and subsequently cooling the hot mixture. In this instance, a lubricant melts by itself when it is used singly, and lubricants melt which have melting points of lower than the heating temperature when two or more lubricants are used together. In the case of a combination of compatible materials, a composite melt is formed. The molten lubricant coats the alloying powder by means of capillarity, and during successive coagulation, fixes the alloying powder and, if any, a part of non-molten lubricants to the iron-based powder. Here, the non-molten lubricants occur in the case where two or more lubricants are used, but some of the lubricants do not form a composite melt together with a lubricant that has melted upon heating. A portion of the non-molten lubricants sometimes remains free without fixing to the iron-based powder.

In the compacting of the iron-based powder composition, the lubricant for use as a binder facilitates rearrangement and plastic deformation of the powders. Hence, the lubricant should desirably be uniformly dispersed on the surface of the iron-based powder. On the other hand, the ejection force in ejecting the compact after the compacting is decreased by a free lubricant secondarily mixed and induced from the iron-based powder surface, or further by a lubricant primarily mixed, but fixed in a non-molten state to the iron-based powder, and a non-molten lubricant left free upon coagulation.

To well balance the above-mentioned modes of operation of the lubricants, the content of lubricant located in a free state between the iron-based particles is preferably in the range of from about 25 to about 80% by mass based on the total amount of the lubricants used. Contents of less than about 25% by mass cause too small of a decrease in mold opening force and hence for scars on the surface of the resultant molding. Contents of more than about 80% by mass fail to firmly fix the alloying powder to the iron-based powder, so that the former powder segregates, rendering the finished product irregular in its properties and impairing the working environment due to dusting during compacting.

Of the lubricants contained in the iron-based powder composition, a lubricant to be melted and fixed to the iron-based powder should preferably be selected from a composite melt composed of metallic soaps, particularly a calcium soap and a lithium soap, and a composite melt composed of a calcium soap and an amide lubricant. According to research conducted by the present inventors, it has been discovered that the interaction between the particles of the iron-based powder mixture is dominated by the intermolecular (van der Woals) force of the particles. This force is dependent upon the molecular weights of the substances present on the powder surfaces, as well as on the magnitudes of roughness on the powder surfaces. The intermolecular force decreases as the molecular weights are reduced, and as the roughness magnitudes are increased (see "Powder and Powder Metallurgy" edited by Uenosono, Ozaki and Ogura, vol. 45, p. 849 (1998)). Generally, lubricants have high molecular weights and hence give large intermolecular force to the particles of the iron-based powder composition, causing poor flowability of the latter powder composition. To obtain improved flowability of the iron-based powder composition, it is effective to adsorb water with low-molecular weight on the surfaces of the lubricants in their monomolecular layers. The composite melt composed of a calcium soap and a lithium soap, and the composite melt composed of a calcium soap and an amide lubricant are relatively highly adsorptive of water so that these melts are capable of reducing the interaction between the particles of the iron-based powder composition and hence of improving the flowability of the iron-based powder composition to a remarkably great extent.

These composite melts pose no problems even if they have a relatively high-melting lubricant partly melted with a non-molten portion. The melting point of each such composite melt is intermediate between the melting points of the two constituent substances. The melting point of the lubricant to be melted and fixed, therefore, can be controlled by varying the formulations of these substances according to the working temperatures for the iron-based powder composition.

As the calcium soap that can be used as the lubricant to be melted and fixed to the iron-based powder and is acceptable for the composite melt, there can be used at least one member selected from among calcium stearate, calcium hydroxystearate, calcium laurate and the like. The lithium soap is at least one member chosen from lithium stearate, lithium hydroxystearate and the like.

As the amide lubricant for use in the composite melt, amide lubricants are preferred which have higher melting points than the metallic soaps described above. For example, suitable amide lubricants are represented by the following formula:

$$C_zH_{2z+1}CONH(CH_2)_2NH(CO(CH_2)_8CONH(CH_2)_2NH)_x COC_yH_{2y+1} \quad (1)$$

where the subscript x denotes an integer of from 1 to 5, the subscript y denotes an integer of 17 or 18, and the subscript z denotes an integer of 17 or 18. A specific example is chosen from at least one member indicated below.

$$C_{17}H_{35}CONH(CH_2)_2NH(CO(CH_2)_8CONH(CH_2)_2NH)_xCOC_{17}H_{35}$$

$$C_{18}H_{35}CONH(CH_2)_2NH(CO(CH_2)_8CONH(CH_2)_2NH)_xCOC_{17}H_{35}$$

and $$C_{18}H_{35}CONH(CH_2)_2NH(CO(CH_2)_8CONH(CH_2)_2NH)_xCOC_{18}H_{37}$$

In these formulae, the subscript x denotes an integer of from 1 to 5. Desirably, these amide lubricants have a ring and ball softening point of about 210° C. or higher, an acid value of 7 or less and an amine value of 3 or less.

Of the lubricants contained in the iron-based powder composition, a free lubricant powder located between the iron-based particles is used preferably along with a mixed powder composed of amide lubricant and methyl polymethacrylate powder, or along with a lithium soap powder.

The free lubricant powder functions to lessen the ejection force during ejecting compact after completion of the compacting. This free lubricant disperses in between the iron-based powder and the associated die and serves as a roller in a space between the die and the resultant compact, thus reducing frictional force. The lubricant for use as the roller is required to remain solid during compacting even at a higher temperature than the compacting temperature and to disperse uniformly over the surface of the die. A lubricant that can meet these requirements is a lithium soap, or a mixed powder composed of an amide lubricant and a methyl polymethacrylate powder.

Because of its high melting point and layerd crystalline structure, the lithium soap is broken along the cleavage surface during ejecting compacts and gets forcibly spread over the die surface as the ejecting compacts proceeds, consequently allowing the ejection force to lessen effectively. The lithium soap is preferably at least one member among lithium stearate, lithium hydroxystearate and the like.

The methyl polymethacrylate powder is composed preferably of an agglomerate in which primary spherical particles have been agglomerated. The powder having such an agglomerated structure degrades by itself into fine spherical particles during ejecting compact, which fine particles become forcibly spread over the die surface as the ejecting compact proceeds, yielding an effective decrease in ejection force. Also, the agglomerated structure has waves formed on the surface and matched in magnitude with the particle sizes so that it reduces the intermolecular force between the particles of the iron-based powder composition and improves the flowability of the constituent powders.

The primary spherical particles of the methyl polymethacrylate powder have an average diameter preferably ranging from about 0.03 to about 5 $\mu$m. Average diameters of less than about 0.03 $\mu$m are ineffective for reducing intermolecular force, whereas average diameters exceeding about 5 $\mu$m suffer from reduced agglomeration and hence fail to maintain an agglomerated structure. Additionally, the agglomerate derived from primary spherical particles has an average diameter set preferably within the range of from about 5 to about 50 $\mu$m. Average diameters of less than about 5 $\mu$m make the iron-based powder mixture less flowable, and conversely, average diameters of more than about 50 $\mu$m fail to sufficiently disperse the methyl polymethacrylate powder over the die surface during compacting.

The methyl polymethacrylate powder is extremely hard and less compactible in the case of individual use. Thus, this powder should preferably be used as a mixed powder in combination with an amide lubricant that is of a soft nature and is of a layered structure. The amide lubricant used as a free lubricant may be chosen preferably from the same ones as are intended to melt and fix to the iron-based powder as described above.

Accordingly, the first aspect of the this invention provides an iron-based powder composition, which has improved flowability and compactibility and ensures reduced temperature dependence of flowability and compactibility from room temperature to a high temperature region.

The process for producing an iron-based powder composition will then be described which constitutes a second aspect of this invention.

In this process, at least one member of an iron-based powder and an alloying powder is coated with an organoalkoxysilane that has been incorporated in advance with water, followed by primary mixing upon addition of one or more lubricants to both the iron-based powder and the allowing powder. Preferred as one or more lubricants used for the primary mixing are a mixture of a calcium soap and a lithium soap, and a mixture of calcium soap and an amide lubricant. When two or more lubricants are employed, they should preferably have respectively different melting points.

The primary mixture is then heated with stirring at a temperature higher than the melting point of at least one of the lubricants so as to melt at least one lubricant, followed by cooling of the mixture, wherein at least one lubricant has been melted, with stirring. Thus, the alloying powder is bonded to the surface of the iron-based powder surface with the aid of the lubricant which has been melted and fixed to the iron-based powder surface. A non-molten lubricant may also become fixed in some instances. An unfixed lubricant may remain free, but this of course causes no inconvenience. By heating after the primary mixing, an organosiloxane film is formed in a coating ratio of greater than about 80% on the surface of at least one member of the iron-based powder, alloying powder and lubricant. This film is conducive to superior fluidity of the resultant iron-based powder mixture and small temperature dependence of flowability, as well as small temperature dependence of green density.

Subsequently, secondary mixing is performed upon addition of one or more lubricants, whereby an iron-based powder composition is produced. Preferred as one or more lubricants used for the secondary mixing are a mixed powder of an amide lubricant powder and a methyl polymethacrylate powder, and a lithium soap powder.

In the second aspect, organoalkoxysilane coating may be carried out after, in place of before, the primary mixing is completed.

According to a third aspect of this invention in which there is provided another embodiment of the process for producing an iron-based powder mixture, the primary mixture is heated with stirring at a temperature higher than the melting point of at least one of the lubricants so as to melt at least one lubricant, and the molten mixture is cooled with stirring. An organoalkoxysilane that has been incorporated in advance with water is mixed in the course of cooling and in a temperature region of from about 100 to about 140° C., and the alloying powder is bonded to the iron-based powder with the aid of at least one lubricant, which has been melted and fixed to the surface of the iron-based powder. A non-molten lubricant may also be fixed in some instances. An organosiloxane layer is thus formed on the powder surfaces.

When the organoalkoxysilane that has been mixed in advance with water is heated to about 140° C. or higher, a polymerization reaction proceeds before the compound is sufficiently mixed with an iron-based powder composition to be produced. This results in the formation of an organosiloxane layer with a low coating ratio. Inversely, when the organoalkoxysilane is added at below about 100° C., a reaction between the compound and the powder surfaces does not proceed with eventual formation of an organosiloxane layer having a low coating ratio. The resultant iron-based powder composition suffers from poor flowability which, therefore, depends largely upon temperature.

The addition of water to an organoalkoxysilane in advance permits a condensation reaction to proceed more efficiently between the compound and the hydroxyl groups on the surface of an iron-based powder, thereby promoting formation of an organosiloxane layer. The amount of water to be added is set preferably within the range of from about 0.001 to about 1.0% by mass based on the total amount of an organoalkoxysilane used. Water amounts of less than about 0.001% by mass do not produce satisfactory results. Conversely, when water amounts exceed about 1.0% by mass, the organoalkoxysilane polymerizes and gels prior to mixing of the iron-based powder, often failing to form an organosiloxane layer.

In place of water being added in advance to an organoalkoxysilane, water may be added to an iron-based powder and/or an alloying powder, followed by addition of the organoalkoxysilane to the powders. Otherwise, an iron-based powder and/or an alloying powder may be mixed with an organoalkoxysilane, followed by addition of water to the whole mixture. However, when water is added separately as in these alternative ways, the iron-based powder and/or the alloying powder wet-crosslink partly in between their respective particles and become segregated because water is high in surface tension. These powders thus fail to be sufficiently mixed with the organoalkoxysilane to be individually added so that the silanol conversion reaction of the compound cannot readily initiate and proceed, and moreover, the iron-based powder causes rusting.

Organoalkoxysilanes refer to substances having the formula of $R_{4-m}—Si(OC_nH_{2n+1})_m$ where the substituent R denotes an organic group, the subscripts n and m denote integers, and the subscript m denotes an integer of from 1 to 3). As the organic group R, a group is preferable which is effective in imparting reduced friction to an organosiloxane film. To this end, a phenyl group is desired. Suitable organosilanes include phenytrimethoxysilane, diphenyldimethoxysilane, triphenymethoxysilane, phenyltriethoxysilane, diphenyldiethoxysilane, triphenyethoxysilane and the like. The smaller number of alkoxy groups ($C_nH_{2n+1}O—$) present in the organoalkoxysilane is more desirable.

The amount of the organoalkoxysilane to be added is preferably in the range of from about 0.01 to about 0.1 part by weight based on the total amount of a powder mixture (treated powders). Amounts of less than about 0.01 part by weight cause too small a quantity of an organosiloxane layer to be formed, whereas amounts of more than about 0.1 part by weight make the resultant compact less strong.

When the heating temperature exceeds about 250° C. in melting the lubricants, the iron powder is excessively oxidized and hence provides reduced compressibility. Hence, heating should be performed at about 250° C. or less, and at least one of the lubricants should preferably have a melting point of about 250° C. or less.

In the second and third aspects of this invention, one or more lubricants are used for primary mixing. In the case of using two or more lubricants, the lubricants should preferably have respectively different melting points. By mixing two or more lubricants of different melting points with an iron-based powder mixture to be produced, and by setting the pressure molding temperature to be between the highest and lowest melting points of the lubricants, there are prepared two lubricant portions; that is, a molten lubricant and a non-molten lubricant. The molten lubricant contributes to lessening the ejecting force during ejecting compacts after completion of the compacting. The non-molten lubricant accelerates arrangement and plastic deformation of the powders during the compacting. Consequently, the resultant iron- based powder composition is effectively prevented from being segregated and rusted, and the powders are so facilitated as to be arranged and deformed plastically during the compacting pressure of the powder composition so that the ejection force can be lessened during ejecting a compact after the compacting.

The amounts of one or more lubricants used for the primary mixing are preferably in the range of from about 25 to about 80% by mass based on the amounts of the primarily and secondarily mixed lubricants in total. This is capable of ensuring required amounts of a free lubricant and is conducive to improved flowability.

The lowest-melting lubricant among one or more lubricants used for the primary mixing is set to be lower in melting point than the lowest-melting lubricant among one or more lubricants used for the secondary mixing, and the heating temperature during warm compaction is set to be between the melting points of the two lowest-melting lubricants. Thus, the primarily mixed lubricant melts and prevents the iron-based powder composition from deterioration in flowability.

The method of forming an iron-based powder composition into a high-density compact will now be described, which constitutes a fourth aspect of the present invention.

In the method of forming a compact according to the fourth aspect of this invention, warm compacting is preferably effected in which the above-mentioned iron-based powder composition provided in the first aspect is molded with heating. A high-density compact is-thus obtained. The iron-based powder composition of this invention gives a sufficiently compact even by room temperature compacting.

The heating temperature (temperature of powders) in the warm compacting is set preferably within the range of from the lowest melting point and the highest melting point of two or more lubricants primarily and secondarily mixed.

By the use of a heating temperature that is higher than the lowest melting point of the primarily and secondarily mixed lubricants, the resultant molten lubricant uniformly infiltrates by means of capillarity into a gap between the particles and hence facilitates rearrangement and plastic deformation of the particles during pressure compacting, forming a highly compact. The molten lubricant functions as a binder for fixing the alloying powder to the iron-based powder.

On the other hand, when the heating temperature is lower than the highest melting point of the mixed lubricants, a lubricant secondarily mixed and left free, and also a lubricant primarily mixed and left solid, do not melt during compacting but during ejecting of a high-density compact from a die, both lubricants disperse into a space between the die and the compact, thus lessening the ejection force required for the compact to be ejected from the die.

Compacting at a temperature lower than the melting points of all the lubricants invites the absence of a molten lubricant so that the particles cannot undergo sufficient rearrangement and plastic deformation. Also unfavorably, the solid lubricants having stayed in the gap between the particles fail to appear on the surface of the resultant compact while the density is increasing in the molding. The finished compact has poor density.

By contrast, compacting at a temperature higher than the melting points of all the lubricants leads to the absence of a solid lubricant so that the ejection force becomes increased when ejecting the compact from the die, resulting in scarring on the compact surface. Furthermore, the molten lubricants having stayed in the gap between the particles exude on the compact surface while the density is increasing in the compact. This invites coarse voids and hence renders the sintered product mechanically weak.

For actual use, the compact is thereafter sintered in an atmosphere suited for the kind of an iron based powder used, and where desired, is then carburized, followed by hardening and tempering.

The following Examples are given to further illustrate this invention.

INVENTIVE EXAMPLE 1

An iron-powder (iron-based powder A: atomized pure iron powder) of 78 $\mu$m in average diameter for powder metallurgy was mixed in an amount of 1,000 g with naturally occurring graphite powder (an alloying powder) of not more than 23 $\mu$m average diameter and copper powder (an alloying powders) of not more than 25 $\mu$m average diameter in accordance with the formulation ratios (ratios based on the iron based powder and alloying powder in total) listed in TABLE 1 below. Triphenylmethoxysilane (an organoalkoxysilane) that had been mixed in advance with an amount of 0.01% by mass was sprayed in an amount of 0.03 parts by weight based on 100 parts by weight of the iron-based powder and alloying powders (graphite powder and copper powder) in total. Here, the amount of triphenymethoxysilane is equivalent to an amount at which a layer of triphenylsiloxane (an organoalkoxysilane) in a single film can be formed on the powder surfaces in a coating ratio of 100%.

Subsequently, mixing was effected for one minute with use of a high-speed mixer equipped with an agitating blade at 1,000 rpm, followed by mixing (primary mixing) upon addition of 0.2 parts by weight of lithium stearate (melting point (mp): 230° C.) and 0.1 part by weight of calcium stearate (melting point (mp): 148 to 155 ° C.) and at a temperature of 160° C., whereby the organosiloxane was formed on the surfaces of the iron-based powder and alloying powders, and a portion of the lubricants was melted. Cooling was then effected down to 85° C. or lower.

Thus, a mixed powder was prepared (by the primary mixing) in which the alloying powders had been bonded to the iron-based powder by the aid of the lubricant melted and fixed to the latter powder. To this primarily mixed powder, 0.3 parts by weight of lithium stearate was added, and the whole mixture was uniformly mixed (secondary mixing). The secondarily mixed powder was discharged from the mixer and used as an iron-based powder composition according to this invention. The amounts of the added lubricants were parts by weight based on 100 parts by weight of the iron-based powder and alloying powders in total.

Iron-based powder compositions were likewise produced except that triphenylmethoxysilane that had not been mixed in advance with water was sprayed (Comparative Example), and triphenylmethoxysilane was not sprayed onto the iron-based powder and alloying powders (Comparative Example).

Inspection was made of the coating ratio of the organosiloxane layer on the powder surfaces, moisture adsorption, flowability and compactibility with regard to the iron based powder compositions obtained above.

(1) Coating Ratio of Organosiloxane Layer:

An iron-based powder composition coated with organosiloxane was immersed in an amount of 200 g in ethanol, followed by thorough stirring of the immersion and by subsequent removal of solid matter therefrom. The quantities B (mol) of organosiloxane and organoalkoxysilane were qualitatively determined from the amount of silicone eluted in ethanol. The difference between the quantity A (mol) of organoalkoxysilane added in advance and the determined quantity B was taken as the quantity C (mol) of organoalkoxysilane that had contributed to layer formation on the powder surfaces, and the coating ratio (%) of an organosiloxane film on the powder surfaces was expressed by C/A×100 (%).

The amount of organoalkoxysilane required for an organosiloxane film of a single layer to be formed (coating ratio: 100%) was calculated from the following equation:

amount of organoalkoxysilane={(amount (g) of iron-based powder composition)×(specific surface area ($m^2$/g) of iron-based powder composition)}/{minimal coating area ($m^2$/g) of organoalkoxysilane}

The specific surface area of the iron based powder composition was determined by the BET method, and the minimal coating area of organoalkoxysilane was determined to be $78.3\times10^3$/(molecular weight of organoalkoxysilane) that was calculated from Straut-Briegleb' model for molecules.

(2) Water Adsorption:

The amount of wateradsorbed in the iron-based powder composition was measure at room temperature (20° C.) and at relative humidity of 60% by the use of an isothermal water adsorption measuring machine (Bellsorp 18 manufactured by Nippon Bell Co.). Thereafter, about 5 g of the iron-based powder composition was let to stand for one hour in a constant-temperature constant-humidity bath (temperature: 25° C., relative humidity: 60%) and put into a glass container. Gas was vacuum-suctioned which had evolved in the glass container when the latter was heated at each temperature of room temperature (25° C.) to 150° C. The suctioned gas was introduced in a container cooled at −20° C., and the amount of entrapped water was measured to determine the amount of moisture that had been eliminated from the iron-based powder composition. The water adsorption at each test temperature was counted by subtracting the amount of eliminated water from the amount of water obtained at room temperature.

(3) Flowability:

The iron-based powder composition was discharged in an amount of 100 g from an orifice with a diameter of 5 mm and at each temperature of from room temperature (25° C.) to 150° C. Fluidity was checked by measuring the time (flowabitily) (sec) required for discharging to be completed. With the heating temperature raised, the coagulation-initiating temperature was determined by measuring the temperature (the temperature at which to initiate coagulation) at which the particles had so coagulated as not to flow.

(4) Green Density Measurement Test (Compactibility Test):

The iron-based powder composition was charged in an amount of 7.5 g into a tablet die with an internal diameter of 11 mm and then compacted at a compacting pressure of 686 MPa and at a compacting temperature of from 25 to 150° C. with consequential measurement of the green density. This density was counted by the ratio of compact weight to compact volume determined from the tablet dimension.

The results are tabulated in TABLE 1.

TABLE 1

| Mixture No. | Iron-Based Powder * | Alloying Powder: Graphite powder ** (%) | Alloying Powder: Copper powder ** (%) | Organo-alkoxysilane: Sub-stance *** | Organo-alkoxysilane: Spray amount *** part by weight | Water Addition | Coating Ratio of Organo-siloxane Powder Film % | Lubricant [kind and amount (part by weight)]****: Primary mixing | Lubricant: Secondary mixing | Lubricant: Secondary mixing: Contents |
|---|---|---|---|---|---|---|---|---|---|---|
| 1-1 | A | 0.8 | 2.0 | a | 0.03 | yes | 91 | Calcium stearate: 0.1 (mp: 148 to 155° C.) Lithium stearate: 0.2 (mp: 230° C.) | Lithium stearate: 0.3 | % by mass 50 |
| 1-2 | A | 0.8 | 2.0 | a | 0.03 | no | 75 | Calcium stearate: 0.1 (mp: 148 to 155° C.) Lithium stearate: 0.2 (mp: 230° C.) | Lithium stearate: 0.3 | 50 |
| 1-3 | A | 0.8 | 2.0 | — | — | — | 0 | Calcium stearate: 0.1 (mp: 148 to 155° C.) Lithium stearate: 0.2 (mp: 230° C.) | Lithium stearate: 0.3 | 50 |

| Mixture No. | Heating Temperature for Primary Mixing (° C.) | Measurement Temperature (° C.) | Water Adsorption (ml/g) | Flowability: Flowability (sec/100 g) | Flowability: Temperature at which coagulation initiates (° C.) | Green density ($Mg/m^3$) | Remarks |
|---|---|---|---|---|---|---|---|
| 1-1 | 160 | 25 | 0.15 | 15.3 | 172 | 7.24 | Inventive Example |
| | | 80 | 0.15 | 15.2 | | 7.25 | |
| | | 130 | 0.14 | 15.1 | | 7.28 | |
| | | 150 | 0.13 | 15.5 | | 7.30 | |
| 1-2 | 160 | 25 | 0.16 | 15.0 | 160 | 7.20 | Comparative Example |
| | | 80 | 0.12 | 16.5 | | 7.22 | |
| | | 130 | 0.10 | 18.9 | | 7.28 | |
| | | 150 | 0.08 | 19.2 | | 7.30 | |
| 1-3 | 160 | 25 | 0.16 | 14.9 | 155 | 7.18 | Comparative Example |
| | | 80 | 0.13 | 17.1 | | 7.20 | |
| | | 130 | 0.08 | 18.9 | | 7.27 | |
| | | 150 | 0.05 | 19.5 | | 7.31 | |

Notes
*A: atomized pure iron powder
**percentage by mass relative to total amount (iron-based powder plus alloying powder)
***a: triphenylmethoxysilane spray amount: parts by weight relative to total amount of 100 parts by weight of mixture
****parts by weight relative to total amount of 100 parts by weight (iron-based powder plus alloying powder)

The Inventive Examples reveal a low water adsorption at room temperature, as well as a small temperature dependence of water adsorption and a small temperature dependence of flowability. Moreover, in the Inventive Examples, the green density is less likely to decline at room temperature and is less variable within the test temperature range.

In contrast, in a Comparative Example (Mixture No. 1-2), which falls outside the scope of this invention because triphenylmethoxysilane that had been mixed in advance with water was sprayed so that an organosiloxane layer was formed less abundantly on the latter surfaces, flowability is acceptable at temperatures from room temperature to 130° C., but flowability is insufficient at higher temperatures. Another defect is that this Comparative Example becomes coagulated at relatively low temperatures.

In another Comparative Example (Mixture No. 1-3), which departs from the scope of this invention because no triphenylmethoxysilane was sprayed so that no organosiloxane layer was formed on the powder surfaces, the water adsorption is high with good flowability at room temperature, but is deficient with insufficient flowability at higher temperatures. This Comparative Example is also defective in that the green density is more largely variable than in the Inventive Examples.

INVENTIVE EXAMPLE 2

An iron-powder (iron-based powder A: atomized pure iron powder) of 78 μm average diameter for powder metallurgy was mixed an amount of 1,000 g with naturally occurring graphite powder (an alloying powder) of not more than 23 μm average diameter and copper powder (an alloying powder) of not more than 25 μm average diameter accordance with the formulation ratios (the ratios based on the iron-based powder and alloying powders in total) listed in TABLE 2 below. An organoalkoxysilane that had been mixed in advance with water in an amount of 0.01% by mass was sprayed in an amount of 0.05 part by weight based on 100 parts by weight of the iron-based powder and alloying powders (graphite powder and copper powder) in total. Here, the amount of organoalkoxysilane is equivalent to an amount at which an organosiloxane film of a single layer can be formed on the powder surfaces in a coating ratio of 100%. Subsequently, mixing (primary mixing) was effected for one minute using a high-speed mixer equipped with an agitating blade at 1,000 rpm, followed by addition of the lubricants of the kinds and amounts listed in TABLE 2 and at the varying temperatures listed in TABLE 2. An organosiloxane layer was thus formed on the surfaces of the iron-based powder and alloying powders, and a portion of the lubricants was melted. Cooling was then effected down to 80° C. or lower.

Thus, a mixed powder was prepared (by the primary mixing) in which the alloying powders had been bonded to the iron-based powder by the aid of the lubricant melted and fixed to the latter powder. To this primarily mixed powder, the kinds and amounts of lubricants shown in TABLE 2 were uniformly mixed (secondary mixing). The secondarily mixed powder was discharged from the mixer and used as an iron-based powder mixture according to this invention. The amounts of the added lubricants were parts by weight based on 100 parts by weight of the iron-based powder and alloying powders in total.

An iron-based powder composition was likewise produced except that organoalkoxysilane that had not been mixed in advance with water was sprayed (Comparative Example).

In the same manner as in Inventive Example 1, inspection was made of the coating ratio of the organosiloxane layer on the powder surfaces, water adsorption, flowability and compactibility with regard to the iron-based powder composition obtained above.

The results are tabulated in TABLES 2-1 and 2-2.

TABLE 2-1

| Composition No. | Iron-Based Powder * | Alloying Powder: Graphite powder ** (%) | Alloying Powder: Copper powder ** (%) | Organoalkoxysilane: Substance *** | Organoalkoxysilane: Spray amount *** part by weight | Water Addition | Coating Ratio of Organosiloxane Powder Film % | Lubricant [kind and amount (part by weight)]****: Primary mixing | Secondary mixing | Contents |
|---|---|---|---|---|---|---|---|---|---|---|
| 2-1 | A | 0.9 | 3.0 | d | 0.05 | yes | 97 | Calcium stearate: 0.1 (mp: 148 to 155° C.) Lithium stearate: 0.1 (mp: 230° C.) | Lithium stearate: 0.3 | % by mass 60 |
| 2-2 | A | 0.9 | 3.0 | e | 0.05 | yes | 93 | Calcium stearate: 0.1 (mp: 148 to 155° C.) Lithium stearate: 0.1 (mp: 230° C.) | Lithium stearate: 0.3 | 60 |
| 2-3 | A | 0.9 | 3.0 | b | 0.05 | yes | 95 | Calcium stearate: 0.1 (mp: 148 to 155° C.) Lithium stearate: 0.1 (mp: 230° C.) | Lithium stearate: 0.3 | 60 |
| 2-4 | A | 0.9 | 3.0 | c | 0.05 | yes | 98 | Calcium stearate: 0.1 (mp: 148 to 155° C.) Lithium stearate: 0.1 (mp: 230° C.) | Lithium stearate: 0.3 | 60 |

| Composition No. | Heating Temperature for Primary Mixing (° C.) | Measurement Temperature (° C.) | Water Adsorption (ml/g) | Flowability: Flowability (sec/100 g) | Flowability: Temperature at which coagulation initiates (° C.) | Green density ($Mg/m^3$) | Remarks |
|---|---|---|---|---|---|---|---|
| 2-1 | 160 | 25 | 0.17 | 14.8 | 175 | 7.22 | Inventive Example |
| | | 80 | 0.17 | 14.7 | | 7.24 | |

TABLE 2-1-continued

| | | | | | | | |
|---|---|---|---|---|---|---|---|
| | | 130 | 0.16 | 14.6 | | 7.26 | |
| | | 150 | 0.15 | 14.8 | | 7.29 | |
| 2-2 | 160 | 25 | 0.18 | 15.0 | 173 | 7.22 | Inventive Example |
| | | 80 | 0.18 | 14.9 | | 7.25 | |
| | | 130 | 0.17 | 14.8 | | 7.26 | |
| | | 150 | 0.16 | 14.9 | | 7.30 | |
| 2-3 | 160 | 25 | 0.18 | 14.7 | 174 | 7.23 | Inventive Example |
| | | 80 | 0.18 | 14.6 | | 7.25 | |
| | | 130 | 0.17 | 14.5 | | 7.27 | |
| | | 150 | 0.15 | 14.8 | | 7.30 | |
| 2-4 | 160 | 25 | 0.17 | 14.8 | 176 | 7.22 | Inventive Example |
| | | 80 | 0.17 | 14.8 | | 7.25 | |
| | | 130 | 0.16 | 14.6 | | 7.28 | |
| | | 150 | 0.16 | 14.8 | | 7.30 | |

Notes
*A: atomized pure iron powder
**percentage by mass relative to total amount (iron-based powder plus alloying powder)
***b: diphenyldimethoxysilane, c: phenyltrimethoxysilane, d: isobutyltrimethoxysilane, e: methyltriethoxysilane spray amount: parts by weight relative to total amount of 100 parts by weight of mixture
****parts by weight relative to total amount of 100 parts by weight (iron-based powder plus alloying powder)

TABLE 2-2

| Composition No. | Iron-Based Powder * | Alloying Powder: Graphite powder ** (%) | Alloying Powder: Copper powder ** (%) | Organo-alkoxysilane: Substance *** | Organo-alkoxysilane: Spray amount *** part by weight | Water Addition | Coating Ratio of Organo-siloxane Powder Layer % | Lubricant [kind and amount (part by weight)]****: Primary mixing | Lubricant [kind and amount (part by weight)]****: Secondary mixing | Lubricant [kind and amount (part by weight)]****: Secondary mixing: Contents |
|---|---|---|---|---|---|---|---|---|---|---|
| 2-5 | A | 0.9 | 3.0 | e | 0.05 | no | 65 | Calcium stearate: 0.1 (mp: 148 to 155° C.) Lithium stearate: 0.1 (mp: 230° C.) | Lithium stearate: 0.3 | % by mass 60 |
| 2-6 | A | 0.9 | 3.0 | b | 0.05 | no | 50 | Calcium stearate: 0.1 (mp: 148 to 155° C.) Lithium stearate: 0.1 (mp: 230° C.) | Lithium stearate: 0.3 | 60 |
| 2-7 | A | 0.9 | 3.0 | c | 0.05 | no | 55 | Calcium stearate: 0.1 (mp: 148 to 155° C.) Lithium stearate: 0.1 (mp: 230° C.) | Lithium stearate: 0.3 | 50 |

| Composition No. | Heating Temperature for Primary Mixing (° C.) | Measurement Temperature (° C.) | Water Adsorption (ml/g) | Flowability: Flowability (sec/100 g) | Flowability: Temperature at which coagulation initiates (° C.) | Green density (Mg/m$^3$) | Remarks |
|---|---|---|---|---|---|---|---|
| 2-5 | 160 | 25 | 0.21 | 14.3 | 155 | 7.21 | Comparative Example |
| | | 80 | 0.20 | 14.5 | | 7.22 | |
| | | 130 | 0.17 | 14.9 | | 7.24 | |
| | | 150 | 0.15 | 16.9 | | 7.29 | |
| 2-6 | 160 | 25 | 0.25 | 14.1 | 150 | 7.21 | Comparative Example |
| | | 80 | 0.22 | 14.7 | | 7.23 | |
| | | 130 | 0.18 | 15.1 | | 7.25 | |
| | | 150 | 0.16 | 17.3 | | 7.30 | |
| 2-7 | 160 | 25 | 0.23 | 14.2 | 158 | 7.21 | Comparative Example |
| | | 80 | 0.20 | 15.0 | | 7.22 | |
| | | 130 | 0.15 | 15.7 | | 7.25 | |
| | | 150 | 0.13 | 17.4 | | 7.28 | |

Notes
*A: atomized pure iron powder
**percentage by mass relative to total amount (iron-based powder plus alloying powder)
***b: diphenyldimethoxysilane, c: phenyltrimethoxysilane, d: isobutyltrimethoxysilane, e: methyltriethoxysilane spray amount: parts by weight relative to total amount of 100 parts by weight of mixture
****parts by weight relative to total amount of 100 parts by weight (iron-based powder plus alloying powder)

The Inventive Examples reveal a low water adsorption at room temperature, as well as a small temperature dependence of water adsorption and a small temperature dependence of flowability. Moreover, in the Inventive Examples, the green density is less likely to decline at room temperature and is less variable within the test temperature range.

In contrast, in Comparative Examples (Mixture No. 2-5, No. 2-6 and No. 2-7) which fall outside the scope of this invention because organoalkoxysilanes that had been mixed in advance with water was sprayed so that an organosiloxane layer was formed less abundantly on the powder surfaces, flowability is acceptable at from room temperature to 120° C., but is not sufficient at temperatures of higher than this upper limit, but far lower than the melting points of the added lubricants. Coagulation also initiates at these low temperatures.

INVENTIVE EXAMPLE 3

An iron-powder (iron-based powder B: reduced iron powder) of 78 μm average diameter for powder metallurgy was mixed in an amount of 1,000 g with naturally occurring graphite powder (an alloying powder) of not more than 23 μm average diameter and copper powder (an alloying powders) of not more than 25 μm average diameter in accordance with the formulation ratios (ratios based on the iron-based powder and alloying powder in total) listed in TABLE 3 below. To the mixture were added 0.15 parts by weight of calcium stearate (melting point (mp): 148 to 155° C.) and 0. 1 5 part by weight of lithium hydroxystearate (melting point (mp): 216° C.), both such amounts being based on 100 parts by weight of the iron-based powder and alloying powders in total, by mixing (primary mixing) of the whole mixture and by subsequent dissolution of the calcium stearate with heating at 160° C. Cooling was then effected down to 110° C. to once again coagulate the calcium stearate, thereby bonding the alloying powders and non-molten calcium stearate to the surface of the iron-based powder. At this stage of processing, triphenylmethoxysilane (an organoalkoxysilane) that had been mixed in advance with an amount of 0.01% by mass was sprayed in an amount of 0.03 parts by weight based on 100 parts by weight of the iron-based powder and alloying powders in total. Mixing was performed for one minute using a high-speed mixer equipped with a 1,000 rpm-agitating blade, followed by cooling down to 85° C. or lower.

Thus, an organosiloxane layer was formed on the powder surfaces, and a mixed powder was prepared in which the alloying powders had been bonded to the iron-based powder with the aid of the lubricant melted and fixed to the latter powder. To this mixed powder was added 0.3 parts by weight of lithium stearate (melting point (mp): 230° C.), and the whole mixture was uniformly mixed (secondary mixing). The secondarily mixed powder was discharged from the mixer and used as an iron-based powder mixture according to this invention.

Iron-based powder mixtures were produced except that triphenylmethoxysilane (an organoalkoxysilane) having not been mixed in advance with water was sprayed on the iron-based powder and alloying powders (Comparative Example), and triphenylmethoxysilane (an organoalkoxysilane) was not sprayed on the iron-based powder, alloying powders and lubricants (Comparative Example).

In the same manner as used in Inventive Example 1, the coating ratio of the organosiloxane layer on the powder surfaces, water adsorption, flowability and compressibility were examined with regard to the iron-based powder compositions thus obtained.

The results are tabulated in TABLE 3.

TABLE 3

| Composition No. | Iron-Based Powder * | Alloying Powder: Graphite powder ** (%) | Alloying Powder: Copper powder ** (%) | Organo-alkoxysilane: Substance *** | Organo-alkoxysilane: Spray amount *** part by weight | Water Addition | Coating Ratio of Organo-siloxane Powder Layer % | Lubricant [kind and amount (part by weight)]****: Primary mixing | Lubricant: Secondary mixing | Lubricant: Secondary mixing: Contents |
|---|---|---|---|---|---|---|---|---|---|---|
| 3-1 | B | 0.5 | 1.5 | a | 0.03 | yes | 93 | Calcium stearate: 0.15 (mp: 148 to 155° C.) Lithium stearate: 0.15 (mp: 230° C.) | Lithium stearate: 0.3 | % by mass 50 |
| 3-2 | B | 0.5 | 1.5 | a | 0.03 | no | 73 | Calcium stearate: 0.15 (mp: 148 to 155° C.) Lithium stearate: 0.15 (mp: 230° C.) | Lithium stearate: 0.3 | 50 |
| 3-3 | B | 0.5 | 1.5 | — | — | — | 0 | Calcium stearate: 0.15 (mp: 148 to 155° C.) Lithium stearate: 0.15 (mp: 230° C.) | Lithium stearate: 0.3 | 50 |

| Composition No. | Heating Temperature for Primary Mixing (° C.) | Measurement Temperature (° C.) | Water Adsorption (ml/g) | Flowability: Flowability (sec/100 g) | Flowability: Temperature at which coagulation initiates (° C.) | Green density (Mg/m$^3$) | Remarks |
|---|---|---|---|---|---|---|---|
| 3-1 | 160 | 25 | 0.15 | 15.4 | 173 | 7.23 | Inventive Example |
| | | 80 | 0.14 | 15.3 | | 7.25 | |
| | | 130 | 0.13 | 15.3 | | 7.28 | |

TABLE 3-continued

| | | | | | | | |
|---|---|---|---|---|---|---|---|
| | | 150 | 0.12 | 15.6 | | 7.30 | |
| 3-2 | 160 | 25 | 0.17 | 15.5 | 160 | 7.21 | Comparative Example |
| | | 80 | 0.15 | 15.5 | | 7.23 | |
| | | 130 | 0.11 | 18.7 | | 7.25 | |
| | | 150 | 0.06 | 19.3 | | 7.28 | |
| 3-3 | 160 | 25 | 0.17 | 15.3 | 155 | 7.22 | Comparative Example |
| | | 80 | 0.16 | 17.3 | | 7.24 | |
| | | 130 | 0.10 | 19.1 | | 7.27 | |
| | | 150 | 0.05 | 24.0 | | 7.29 | |

Notes
*B: reduced iron powder
**percentage by mass relative to total amount (iron-based powder plus alloying powder)
***a: triphenylmethoxysilane spray amount: parts by weight relative to total amount of 100 parts by weight of mixture
****parts by weight relative to total amount of 100 parts by weight (iron-based powder plus alloying powder)

As is favorably comparable with Inventive Example 1, the examples of Inventive Example 3 reveal a low water adsorption at room temperature, as well as a small temperature dependence of water adsorption and a small temperature dependence of flowability. Moreover, it has been found in the Inventive Examples that the green density is less likely to decline at room temperature and is less variable within the test temperature range. In contrast, the Comparative Examples are largely dependent in water adsorption, flowability and green density on temperature. Besides and defectively, the Comparative Examples become coagulated at lower temperatures than in the Inventive Examples.

INVENTIVE EXAMPLE 4

A steel powder (iron-based powder A: atomized pure iron powder, C, D and E: partially alloyed steel powders, and F and G: completely alloyed steel powders) of 78 μm average diameter (99% by mass on the average) for powder metallurgy was mixed in an amount of 1,000 g with naturally occurring graphite powder (an alloying powder) of not more than 23 μm average diameter and copper powder (an alloying powders) of not more than 25 m average diameter in accordance with the formulation ratios (the ratios based on the iron-based powder and alloying powders in total) listed in TABLE 4 below. An organoalkoxysilane that had been mixed in advance with water was sprayed in the amounts shown in TABLE 4 and based on 100 parts by weight of the iron-based powder and alloying powders in total. The whole mixture was mixed for one minute using a high-speed mixer equipped with an agitating blade at 1,000 rpm, followed by addition of lubricants in the formulation ratios shown in TABLE 4. Mixing (primary mixing) was effected with heating at 160° C. to thereby melt one or more lubricants, and the resultant molten lubricant was recoagulated upon cooling down to 85° C. or below. To this mixture were then added different lubricants in the ratios shown in TABLE 4, followed by uniform mixing (secondary mixing) of the whole mixture. The secondarily mixed powder was discharged from the mixer and used as an iron-based powder composition according to this invention. The amounts of the lubricants to be added were by parts by weight based on 100 parts by weight of the iron-based powder and alloying powders in total.

With the same formulations of organoalkoxysilanes and lubricants as in Inventive Example 4, various iron-based powder compositions (Mixture Nos. 4-2, 4-4, 4-6, 4-8, 4-1 0 and 4-12) were produced except that heating was omitted in the primary mixing. An iron-based powder composition (Mixture No. 4-13) was also produced, by the procedure of Inventive Example 4, except that mixing was simply performed with a V blender with omission of organoalkoxysilane spraying and with use of lubricants outside the scope of this invention.

As in Inventive Example 1, the coating ratio of the organosiloxane layer on the powder surfaces, water adsorption, flowability and compactibility were examined with regard to the iron-based powder composition thus obtained.

The results are tabulated in TABLES 4-1 to 4-4.

TABLE 4-1

| Composition No. | Iron-Based Powder * | Alloying Powder: Graphite powder ** (%) | Alloying Powder: Copper powder ** (%) | Organo-alkoxysilane: Substance *** | Organo-alkoxysilane: Spray amount *** part by weight | Water Addition | Coating Ratio of Organo-siloxane Powder Layer % | Lubricant [kind and amount (part by weight)]*****: Primary mixing | Lubricant: Secondary mixing | Lubricant: Secondary mixing Contents |
|---|---|---|---|---|---|---|---|---|---|---|
| 4-1 | A | 0.8 | 2.0 | a | 0.01 | yes | 95 | Calcium stearate: 0.1 (mp: 148 to 155° C.) Lithium stearate: 0.2 (mp: 230° C.) | Lithium stearate: 0.3 | % by mass 50 |
| 4-2 | A | 0.8 | 2.0 | a | 0.01 | yes | 33 | Calcium stearate: 0.1 (mp: 148 to 155° C.) Lithium stearate: 0.2 (mp: 230° C.) | Lithium stearate: 0.3 | 50 |

TABLE 4-1-continued

| | | | | | | | | | | |
|---|---|---|---|---|---|---|---|---|---|---|
| 4-3 | C | 0.8 | 0 | b | 0.01 | yes | 92 | Calcium stearate: 0.1 (mp: 148 to 155° C.) Amide lubricant (a)****: 0.2 (mp: 215° C.) | Hydroxy-lithium stearate: 0.3 | 50 |
| 4-4 | C | 0.8 | 0 | b | 0.01 | yes | 36 | Calcium stearate: 0.1 (mp: 148 to 155° C.) Amide lubricant (a)****: 0.2 (mp: 215° C.) | Hydroxy-lithium stearate: 0.3 | 50 |

| | | | | Flowability | | | |
|---|---|---|---|---|---|---|---|
| Composition No. | Heating Temperature for Primary Mixing (° C.) | Measurement Temperature (° C.) | Water Adsorption (ml/g) | Flowability (sec/100 g) | Temperature at which coagulation initiates (° C.) | Green density (Mg/m$^3$) | Remarks |
| 4-1 | 160 | 25 | 0.15 | 13.5 | 175 | 7.26 | Inventive Example |
| | | 80 | 0.15 | 13.4 | | 7.27 | |
| | | 130 | 0.14 | 13.3 | | 7.34 | |
| | | 150 | 0.13 | 13.5 | | 7.35 | |
| 4-2 | — | 25 | 0.18 | 13.1 | 160 | 7.20 | Comparative Example |
| | | 80 | 0.15 | 13.0 | | 7.25 | |
| | | 130 | 0.10 | 13.5 | | 7.31 | |
| | | 150 | 0.05 | 14.3 | | 7.31 | |
| 4-3 | 160 | 25 | 0.13 | 14.0 | 178 | 7.25 | Inventive Example |
| | | 80 | 0.13 | 13.8 | | 7.26 | |
| | | 130 | 0.12 | 13.5 | | 7.32 | |
| | | 150 | 0.11 | 13.7 | | 7.33 | |
| 4-4 | — | 25 | 0.15 | 13.8 | 166 | 7.19 | Comparative Example |
| | | 80 | 0.13 | 14.0 | | 7.22 | |
| | | 130 | 0.08 | 14.4 | | 7.29 | |
| | | 150 | 0.03 | 15.8 | | 7.30 | |

Notes
*A: atomized pure iron powder C: partially alloyed powder (2 Cu type)
**percentage by mass relative to total amount (iron-based powder plus alloying powder)
***a: triphenylmethoxysilane, b: diphenyldimethoxysilane spray amount: parts by weight relative to total amount of 100 parts by weight of mixture
****amide lubricant (a): $C_yN_{2y+1}CONH(CH_2)_2NH(CO(CH_2)_8CONH(CH_2)_2NH)_xCCO_zH_{2z+1}$: x = 1 to 3, y = 17 or 18, z = 17 or 18
*****parts by weight relative to total amount of 100 parts by weight (iron-based powder plus alloying powder)

TABLE 4-2

| | | | | Organo-alkoxysilane | | | Coating Ratio of | | | |
|---|---|---|---|---|---|---|---|---|---|---|
| | Iron- | Alloying Powder | | | Spray | | Organo- | | | |
| Composition | Based | Graphite | Copper | Sub- | amount | | siloxane | Lubricant [kind and amount (part by weight)]***** | | |
| | Powder | powder | powder | stance | *** part | Water | Powder | | Secondary mixing | |
| No. | * | ** (%) | ** (%) | *** | by weight | Addition | Layer % | Primary mixing | | Contents |
| 4-5 | D | 0.3 | 0 | a | 0.01 | yes | 95 | Calcium laurate: 0.1 (mp: 182 to 183° C.) Lithium stearate: 0.1 (mp: 230° C.) Ethylene-bis-stearamide: 0.1 (mp: 148° C.) | Amide lubricant (b)****: 0.2 (mp: 255° C.) Methyl poly-methacrylate: 0.1 | % by mass 40 |
| 4-6 | D | 0.3 | 0 | a | 0.01 | yes | 45 | Calcium laurate: 0.1 (mp: 182 to 183° C.) Lithium stearate: 0.1 (mp: 230° C.) Ethylene-bis-stearamide: 0.1 (mp: 148° C.) | Amide lubricant (b)****: 0.2 (mp: 255° C.) Methyl poly-methacrylate: 0.1 | 50 |
| 4-7 | E | 0.3 | 0 | a | 0.01 | yes | 95 | Calcium stearate: 0.1 (mp: 148 to 155° C.) Amide lubricant (b)****: 0.2 (mp: 255° C.) | Amide lubricant (b)****: 0.2 (mp: 255° C.) Methyl poly-methacrylate: 0.1 | 50 |
| 4-8 | E | 0.3 | 0 | a | 0.01 | yes | 38 | Calcium stearate: 0.1 (mp: 148 to 155° C.) Amide lubricant | Amide lubricant (b)****: 0.2 (mp: 255° C.) | 50 |

TABLE 4-2-continued

| | | | | | | | |
|---|---|---|---|---|---|---|---|
| | | | | | (b)****: 0.2 (mp: 255° C.) | Methyl poly-methacrylate: 0.1 | |
| | | | | Flowability | | | |
| Com-position No. | Heating Temperature for Primary Mixing (° C.) | Measurement Temperature (° C.) | Water Adsorption (ml/g) | Flowability (sec/100 g) | Temperature at which coagulation initiates (° C.) | Green density (Mg/m$^3$) | Remarks |
| 4-5 | 160 | 25 | 0.14 | 14.2 | 178 | 7.23 | Inventive Example |
| | | 80 | 0.14 | 14.1 | | 7.25 | |
| | | 130 | 0.12 | 14.2 | | 7.38 | |
| | | 150 | 0.11 | 14.5 | | 7.30 | |
| 4-6 | — | 25 | 0.15 | 14.0 | 165 | 7.18 | Comparative Example |
| | | 80 | 0.13 | 14.1 | | 7.20 | |
| | | 130 | 0.10 | 14.6 | | 7.27 | |
| | | 150 | 0.06 | 15.5 | | 7.29 | |
| 4-7 | 160 | 25 | 0.13 | 14.0 | 173 | 7.24 | Inventive Example |
| | | 80 | 0.13 | 14.3 | | 7.25 | |
| | | 130 | 0.12 | 14.5 | | 7.27 | |
| | | 150 | 0.10 | 16.0 | | 7.30 | |
| 4-8 | — | 25 | 0.14 | 13.9 | 166 | 7.17 | Comparative Example |
| | | 80 | 0.12 | 14.1 | | 7.19 | |
| | | 130 | 0.09 | 15.1 | | 7.25 | |
| | | 150 | 0.03 | 17.0 | | 7.28 | |

Notes
*D: partially alloyed powder (4 Ni-1.5 Cu-0.5 Mo type), E: partially alloyed powder (2 Ni-1.0 Mo type)
**percentage by mass relative to total amount (iron-based powder plus alloying powder)
***a: triphenylmethoxysilane spray amount: parts by weight relative to total amount of 100 parts by weight of mixture
****amide lubricant (b): $C_yN_{2y+1}CONH(CH_2)_2NH(CO(CH_2)_8CONH(CH_2)_2NH)_xCCO_zH_{2z+1}$: x = 1 to 5, y = 17 or 18, z = 17 or 18 methyl polyacrylate: mean primary particle diameter 0.05 μm, mean aggregate diameter 25 μm
*****parts by weight relative to total amount of 100 parts by weight (iron-based powder plus alloying powder)

TABLE 4-3

| | | | | | | | | | | |
|---|---|---|---|---|---|---|---|---|---|---|
| | | | | Organo-alkoxysilane | | | Coating Ratio of | | | |
| | Iron- | Alloying Powder | | | Spray | | Organo- | | | |
| Com- | Based | Graphite | Copper | Sub- | amount | | siloxane | Lubricant [kind and amount (part by weight)]***** | | |
| position | Powder | powder | powder | stance | *** part | Water | Powder | | Secondary mixing | |
| No. | * | ** (%) | ** (%) | *** | by weight | Addition | Layer % | Primary mixing | | Contents |
| 4-9 | F | 1.0 | 0 | a | 0.05 | yes | 91 | Calcium stearate: 0.15 (mp: 148 to 155° C.) Amide lubricant (a)****: 0.2 (mp: 215° C.) | Lithium stearate: 0.3 Methyl poly-methacrylate: 0.1 | % by mass 50 |
| 4-10 | F | 1.0 | 0 | a | 0.03 | yes | 55 | Calcium stearate: 0.15 (mp: 148 to 155° C.) Amide lubricant (a)****: 0.2 (mp: 215° C.) | Amide lubricant (b)****: 0.2 (mp: 255° C.) Methyl poly-methacrylate: 0.1 | 50 |
| 4-11 | G | 0.8 | 0.2 | b | 0.03 | yes | 93 | Calcium stearate: 0.1 (mp: 148 to 155° C.) Lithium stearate: 0.2 (mp: 230° C.) | Lithium stearate: 0.4 | 57 |

| | | | | | | | |
|---|---|---|---|---|---|---|---|
| | | | | Flowability | | | |
| Com-position No. | Heating Temperature for Primary Mixing (° C.) | Measurement Temperature (° C.) | Water Adsorption (ml/g) | Flowability (sec/100 g) | Temperature at which coagulation initiates (° C.) | Green density (Mg/m$^3$) | Remarks |
| 4-9 | 160 | 25 | 0.13 | 14.3 | 177 | 7.07 | Inventive Example |
| | | 80 | 0.12 | 14.1 | | 7.09 | |
| | | 130 | 0.12 | 14.1 | | 7.11 | |
| | | 150 | 0.10 | 14.2 | | 7.12 | |
| 4-10 | — | 25 | 0.16 | 14.2 | 148 | 7.03 | Comparative Example |
| | | 80 | 0.13 | 14.1 | | 7.05 | |
| | | 130 | impossibly | coagulated | | 7.09 | |

TABLE 4-3-continued

| | | | | | | | |
|---|---|---|---|---|---|---|---|
| | | 150 | measured impossibly measured | coagulated | | 7.11 | |
| 4-11 | 160 | 25 | 0.14 | 14.5 | 175 | 7.18 | Inventive Example |
| | | 80 | 0.13 | 14.3 | | 7.20 | |
| | | 130 | 0.13 | 14.0 | | 7.23 | |
| | | 150 | 0.12 | 14.5 | | 7.25 | |

Notes
*F: completely alloyed powder (3.0 Cr - 0.3 V type) G: completely alloyed powder (1.5 Mo type)
**percentage by mass relative to total amount (iron-based powder plus alloying powder)
***a: triphenylmethoxysilane b: diphenyldimethoxysilane spray amount: parts by weight relative to total amount of 100 parts by weight of mixture
****amide lubricant (a): $C_yN_{2y+1}CONH(CH_2)_2NH(CO(CH_2)_8CONH(CH_2)_2NH)_xCCO_zH_{2z+1}$: x = 1 to 3, y = 17 or 18, z = 17 or 18 amide lubricant (b): $C_yN_{2y+1}CONH(CH_2)_2NH(CO(CH_2)_8CONH(CH_2)_2NH)_xCCO_zH_{2z+1}$: x = 1 to 5, y = 17 or 18, z = 17 or 18
methyl polyacrylate: mean primary particle diameter 0.05 μm, mean aggregate diameter 25 μm
*****parts by weight relative to total amount of 100 parts by weight (iron-based powder plus alloying powder)

TABLE 4-4

| Composition No. | Iron-Based Powder * | Alloying Powder: Graphite powder ** (%) | Alloying Powder: Copper powder ** (%) | Organo-alkoxysilane: Substance *** | Organo-alkoxysilane: Spray amount *** part by weight | Water Addition | Coating Ratio of Organo-siloxane Powder Layer % | Lubricant [kind and amount (part by weight)]****: Primary mixing | Lubricant: Secondary mixing | Lubricant: Secondary mixing: Contents |
|---|---|---|---|---|---|---|---|---|---|---|
| 4-12 | G | 0.8 | 0.2 | b | 0.03 | yes | 58 | Calcium stearate: 0.1 (mp: 148 to 155° C.) Lithium stearate: 0.2 (mp: 230° C.) | Lithium stearate: 0.4 | % by mass 57 |
| 4-13 | G | 0.8 | 0.2 | — | — | — | — | Zinc stearate: (mp: 127° C.) | — | — |

| Composition No. | Heating Temperature for Primary Mixing (° C.) | Measurement Temperature (° C.) | Water Adsorption (ml/g) | Flowability: Flowability (sec/100 g) | Flowability: Temperature at which coagulation initiates (° C.) | Green density ($Mg/m^3$) | Remarks |
|---|---|---|---|---|---|---|---|
| 4-12 | — | 25 | 0.18 | 13.8 | 145 | 7.15 | Comparative Example |
| | | 80 | 0.17 | 14.0 | | 7.18 | |
| | | 130 | 0.12 | 16.3 | | 7.21 | |
| | | 150 | impossibly measured | coagulated | | 7.25 | |
| 4-13 | — | 25 | 0.26 | 13.5 | 120 | 7.16 | Comparative Example |
| | | 80 | 0.21 | 14.2 | | 7.19 | |
| | | 130 | impossibly measured | coagulated | | 7.20 | |
| | | 150 | impossibly measured | coagulated | | 7.23 | |

Notes
*G: completely alloyed powder (1.5 Mo type)
**percentage by mass relative to total amount (iron-based powder plus alloying powder)
***a: triphenylmethoxysilane b: diphenyldimethoxysilane spray amount: parts by weight relative to total amount of 100 parts by weight of mixture
****parts by weight relative to total amount of 100 parts by weight (iron-based powder plus alloying powder)

In the examples-of Inventive Example 4, the coating ratio of an organosiloxane layer on the powder surfaces is higher, and the compression ratio is higher at each test temperature and is less dependent on temperature than in the Comparative Examples. Primary mixing with heating has been found to ensure that a layer formation reaction can proceed to form an organosiloxane layer. It has also been found that the Inventive Examples offer greater flowability and compactibility in a wide temperature range than the Comparative Example using simple mixing.

According to this invention, an iron-based powder composition for powder metallurgy is provided, which is highly flowable and compactible at room temperature or during warming. This powder composition permits the ejection force to lessen in ejecting the resultant compact from a die at room temperature or during warming, thus exhibiting superior. Upon warm compaction in a selected temperature range, the iron-based powder composition provides a high-density compact and hence has an industrially significant effect. Moreover, because the iron-based powder composition is flowable with reduced temperature dependence, it is not necessary to strictly control the temperatures of the powder composition, die and the like so that temperature control is easy to effect compacting. Also advantageously, the iron-based powder composition has a small temperature dependence of green density, producing high green density even at relatively low temperatures.

What is claimed is:

1. An iron-based powder composition for use in powder metallurgy, comprising:

an iron-based powder;

a lubricant melted and fixed to the iron-based powder;

an alloying powder bonded to the iron-based powder with the aid of the lubricant; and a free lubricant powder, wherein at least one member selected from the group consisting of the iron-based powder, lubricant, alloying powder and free lubricant powder is coated on the surface thereof with an organosiloxane in a coating ratio of greater than about 80%.

2. The iron-based powder composition according to claim 1, wherein:

the organosiloxane has phenyl groups as a functional group;

the lubricant is one member selected from the group consisting of a composite melt composed of a calcium soap and a lithium soap, and a composite melt composed of a calcium soap and an amide lubricant; and the free lubricant powder is one member selected from the group consisting of a mixed powder composed of an amide lubricant and a methyl polymethacrylate powder, and a lithium soap powder.

3. The iron-based powder composition according to claim 2, wherein said amide lubricant is represented by the following formula:

$$C_zH_{2z+1}CONH(CH_2)_2NH(CO(CH_2)_8CONH(CH_2)_2NH)_xCOC_yH_{2y+1}$$

where the subscript x denotes an integer of from 1 to 5, the subscript y denotes an integer of 17 or 18, and the subscript z denotes an integer of 17 or 18.

4. The iron-based powder composition according to claim 2, wherein the methyl polymethacrylate powder is an agglomerate of spherical particles.

5. The iron-based powder composition according to claim 3, wherein the methyl polymethacrylate powder is an agglomerate of spherical particles.

6. A method of an iron-based powder composition into a high-density iron-based powder compact, comprising compacting an iron-based powder composition according to claim 1 at a temperature that is higher than the lowest melting point of, but lower than the highest melting point of, the lubricants contained in the iron-based powder composition.

7. A method of forming an iron-based powder composition into a high-density iron-based powder compact, comprising compacting an iron-based powder composition according to claim 2 at a temperature that is higher than the lowest melting point of, but lower than the highest melting point of, the lubricants contained in the iron-based powder composition.

8. A method of forming an iron-based powder composition into a high-density iron-based powder compact, comprising compacting an iron-based powder composition according to claim 3 at a temperature that is higher than the lowest melting point of, but lower than the highest melting point of, the lubricants contained in the iron-based powder composition.

9. A method of forming an iron-based powder composition into a high-density iron-based powder compact, comprising compacting an iron-based powder composition according to claim 4 at a temperature that is higher than the lowest melting point of, but lower than the highest melting point of, the lubricants contained in the iron-based powder composition.

10. A method of forming an iron-based powder composition into a high-20 density iron-based powder compact, comprising compacting an iron-based powder composition according to claim 5 at a temperature that is higher than the lowest melting point of, but lower than the highest melting point of, the lubricants contained in the iron-based powder composition.

11. A process for producing an iron-based powder composition for use in powder metallurgy, comprising:

coating at least one of an iron-based powder and an alloying powder with an organoalkoxysilane that has previously been mixed with water;

primarily mixing the iron-based powder and the alloying powder by the addition of one or more lubricants;

heating the primary mixture with stirring at a temperature higher than the melting point of at least one of the lubricants, thereby melting the at least one lubricant;

cooling the mixture, wherein at least one lubricant has been melted, with stirring, thereby bonding the alloying powder to the iron-based powder with the aid of the at least one lubricant which has been melted and fixed to the surface of the iron-based powder; and subsequently performing secondary mixing by the addition of one or more lubricants.

12. The process for producing an iron-based powder composition according to claim 11, comprising using two or more lubricants as the one or more lubricants in the primary mixing, the two or more lubricants having different melting points from each other.

13. The process for producing an iron-based powder composition according to claim 11, wherein the lowest-melting lubricant of the one or more lubricants used in the primary mixing has a lower melting point than the lowest-melting lubricants of the one or more lubricants used in the secondary mixing, and the heating temperature during the primary mixing is set to be in the middle between the melting points of the two lowest-melting lubricants.

14. The process for producing an iron-based powder composition according to claim 12, wherein the lowest-melting lubricant of the one or more lubricants used in the primary mixing has a lower melting point than the lowest-melting lubricants of the one or more lubricants used in the secondary mixing, and the heating temperature during the primary mixing is set to be in the middle between the melting points of the two lowest-melting lubricants.

15. A process for producing an iron-based powder composition for use in powder metallurgy, comprising:

primarily mixing an iron-based powder and an alloying powder by the addition of one or more lubricants;

heating the primary mixture with stirring at a temperature higher than the melting point of at least one of the lubricants, thereby melting the at least one lubricant;

cooling the mixture, wherein at least one lubricant has been melted, with stirring, mixing an organoalkoxysilane that has previously been mixed with water, in the course of cooling and in a temperature region of from about 100 to about 140° C., and bonding the alloying powder to the iron-based powder with the aid of the at least one lubricant which has been melted and fixed to the surface of the iron-based powder; and subsequently performing secondary mixing by the addition of one or more lubricants.

16. The process for producing an iron-based powder composition according to claim 15, comprising using two or more lubricants as the one or more lubricants in the primary mixing, the two or more lubricants having different melting points from each other.

17. The process for producing an iron-based powder composition according to claim 15, wherein the lowest-melting lubricant of the one or more lubricants used in the primary mixing has a lower melting point than the lowest-melting lubricants of the one or more lubricants used in the secondary mixing, and the heating temperature during the primary mixing is set to be in the middle between the melting points of the two lowest-melting lubricants.

* * * * *

UNITED STATES PATENT AND TRADEMARK OFFICE

CERTIFICATE OF CORRECTION

PATENT NO. : 6,451,082 B1 
DATED : September 17, 2002
INVENTOR(S) : Yukiko Ozaki and Satoshi Uenosono It is certified that error appears in the above-identified patent and that said Letters Patent is hereby corrected as shown below:

Column 33,
Line 44, after "of" insert -- forming --.

Column 34,
Line 6, change "high-20 density" to -- high-density --.

Signed and Sealed this

Twenty-fifth Day of November, 2003

JAMES E. ROGAN
*Director of the United States Patent and Trademark Office*